US008454007B1

(12) United States Patent
Li et al.

(10) Patent No.: US 8,454,007 B1
(45) Date of Patent: Jun. 4, 2013

(54) SHEET SEPARATION MECHANISM

(75) Inventors: Fong-Jhou Li, New Taipei (TW); Wei-Yuan Peng, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/602,539

(22) Filed: Sep. 4, 2012

(51) Int. Cl.
*B65H 3/52* (2006.01)
*B65H 3/34* (2006.01)

(52) U.S. Cl.
USPC ..... 271/121; 271/167

(58) Field of Classification Search
USPC ..... 271/121, 167
See application file for complete search history.

(56) References Cited

U.S. PATENT DOCUMENTS 6,126,161 A * 10/2000 Kato ..... 271/121
6,375,183 B1 * 4/2002 Inoue et al. ..... 271/10.11
6,880,821 B2 * 4/2005 Park ..... 271/121
7,000,916 B2 * 2/2006 Asada et al. ..... 271/121

* cited by examiner

*Primary Examiner* — David H Bollinger
(74) *Attorney, Agent, or Firm* — Muncy, Geissler, Olds & Lowe, PLLC

(57) ABSTRACT

A sheet separation mechanism adapted for being used in an automatic sheet feeding device includes a bearing supporter for positioning papers thereon, a sheet separation spring and a sheet separation holder. The bearing supporter defines a receiving groove. The sheet separation spring shows a rough outer periphery surface. The sheet separation spring is disposed in the receiving groove with an axis thereof being parallel to a bottom wall of the receiving groove. The sheet separation holder mounted to the bearing supporter defines an opening corresponding to the receiving groove. The sheet separation spring is restricted in the receiving groove by the sheet separation holder with a top of the rough outer periphery surface thereof being exposed through the opening beyond a top face of the sheet separation holder so as to separate the papers whereby and further ensure the automatic sheet feeding device transports the papers piece by piece.

3 Claims, 5 Drawing Sheets

SHEET SEPARATION MECHANISM

BACKGROUND OF THE INVENTION

1. Field of the Invention

The present invention generally relates to a sheet separation mechanism, and more particularly to a sheet separation mechanism capable of being used in an automatic sheet feeding device.

2. The Related Art

Referring to FIGS. 1-2, a sheet separation mechanism adapted for being used in an automatic sheet feeding device includes a sheet separation holder 10', a sheet separation rubber element 20' and a foam 30'. A substantial middle of a top of the sheet separation holder 10' defines a receiving groove 11' extending along a longitudinal direction. The sheet separation rubber element 20' is mounted in the receiving groove 11' of the sheet separation holder 10'. A top of the sheet separation rubber element 20' is disposed with a plurality of rubber sheets 21' arranged to a stair-step shape along the longitudinal direction. The foam 30' is located under the sheet separation rubber element 20' so as to provide a buffer force for the sheet separation rubber element 20'. Papers (not shown) are stacked on the sheet separation holder 10'. When a normal force is exerted on the papers by a pickup roller (not shown) to ruckle the papers and feed the papers into the sheet separation mechanism, the papers contact the rubber sheets 21' of the sheet separation rubber element 20'. Then, the sheet separation mechanism separates the papers by virtue of the rubber sheets 21' of the sheet separation rubber element 20' so as to ensure the papers to be transported piece by piece.

However, when the above-mentioned sheet separation mechanism separates the papers by virtue of the rubber sheets 21' of the sheet separation rubber element 20', the papers rub against the rubber sheets 21' of the sheet separation rubber element 20' that is apt to abrase the rubber sheets 21' and further lower a sheet separation utility of the sheet separation mechanism.

SUMMARY OF THE INVENTION

An object of the present invention is to provide a sheet separation mechanism adapted for being used in an automatic sheet feeding device. The sheet separation mechanism includes a bearing supporter for positioning papers thereon, a sheet separation spring and a sheet separation holder. A top of the bearing supporter defines a receiving groove. The sheet separation spring of a helical spring shows a rough outer periphery surface. The sheet separation spring is disposed in the receiving groove of the bearing supporter with an axis thereof being parallel to a bottom wall of the receiving groove. The sheet separation holder is mounted on the bearing supporter, and defines an opening corresponding to the receiving groove. The sheet separation spring is restricted in the receiving groove of the bearing supporter by the sheet separation holder with a top of the rough outer periphery surface thereof being exposed through the opening beyond a top face of the sheet separation holder so as to separate the papers and further ensure the automatic sheet feeding device transports the papers piece by piece.

As described above, the sheet separation spring is restricted in the receiving groove of the bearing supporter by the sheet separation holder with the top of the rough outer periphery surface thereof being exposed through the opening beyond the top face of the sheet separation holder so as to separate the papers and further ensure the automatic sheet feeding device transports the papers piece by piece. Furthermore, the sheet separation spring can provide a buffer force for the papers directly by virtue of its elastic properties for effectively preventing the papers from being abrased. Comparing to the conventional sheet separation mechanism which utilizes the foam to provide the buffer force for the sheet separation rubber element to effectively prevent the papers from being abrased, the sheet separation mechanism according to the present invention uses less components and has a lower cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
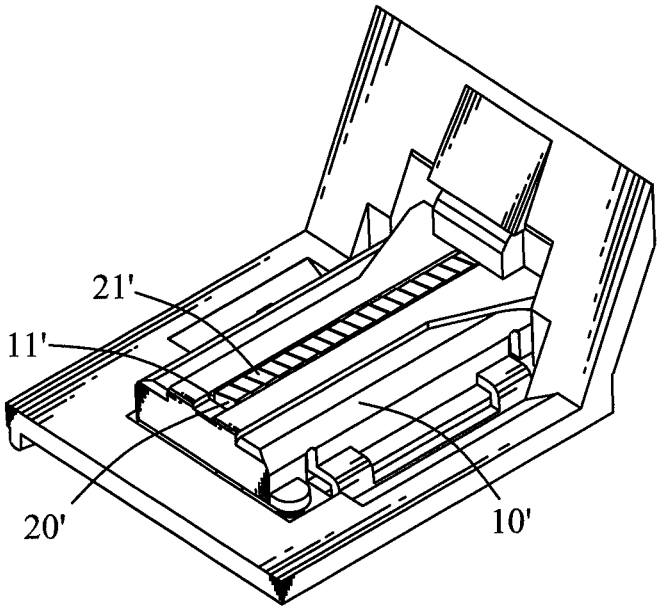
FIG. 1 (Prior Art)
FIG. 1 is a perspective view of a sheet separation mechanism in prior art.
Figure 2:
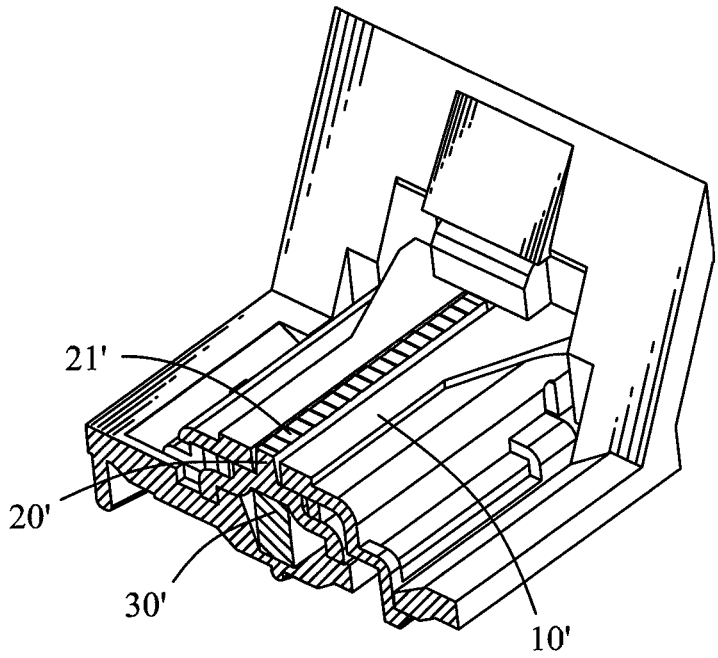
FIG. 2 (Prior Art)
FIG. 2 is a partially sectional view of the sheet separation mechanism of FIG. 1.
Figure 3:
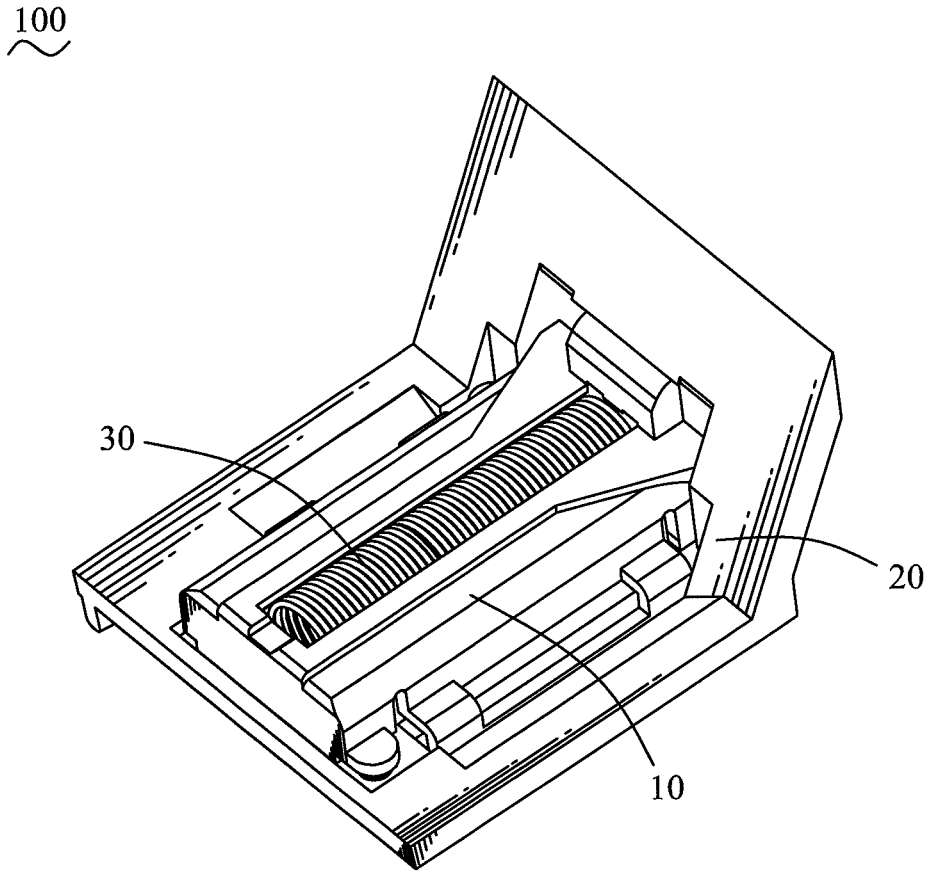
FIG. 3 is a perspective view of a sheet separation mechanism according to the present invention.

With reference to FIG. 3, a sheet separation mechanism 100 in accordance with the present invention is shown. The sheet separation mechanism 100 adapted for being used in an automatic sheet feeding device includes a sheet separation holder 10, a bearing supporter 20 and a sheet separation spring 30.

Figure 4:
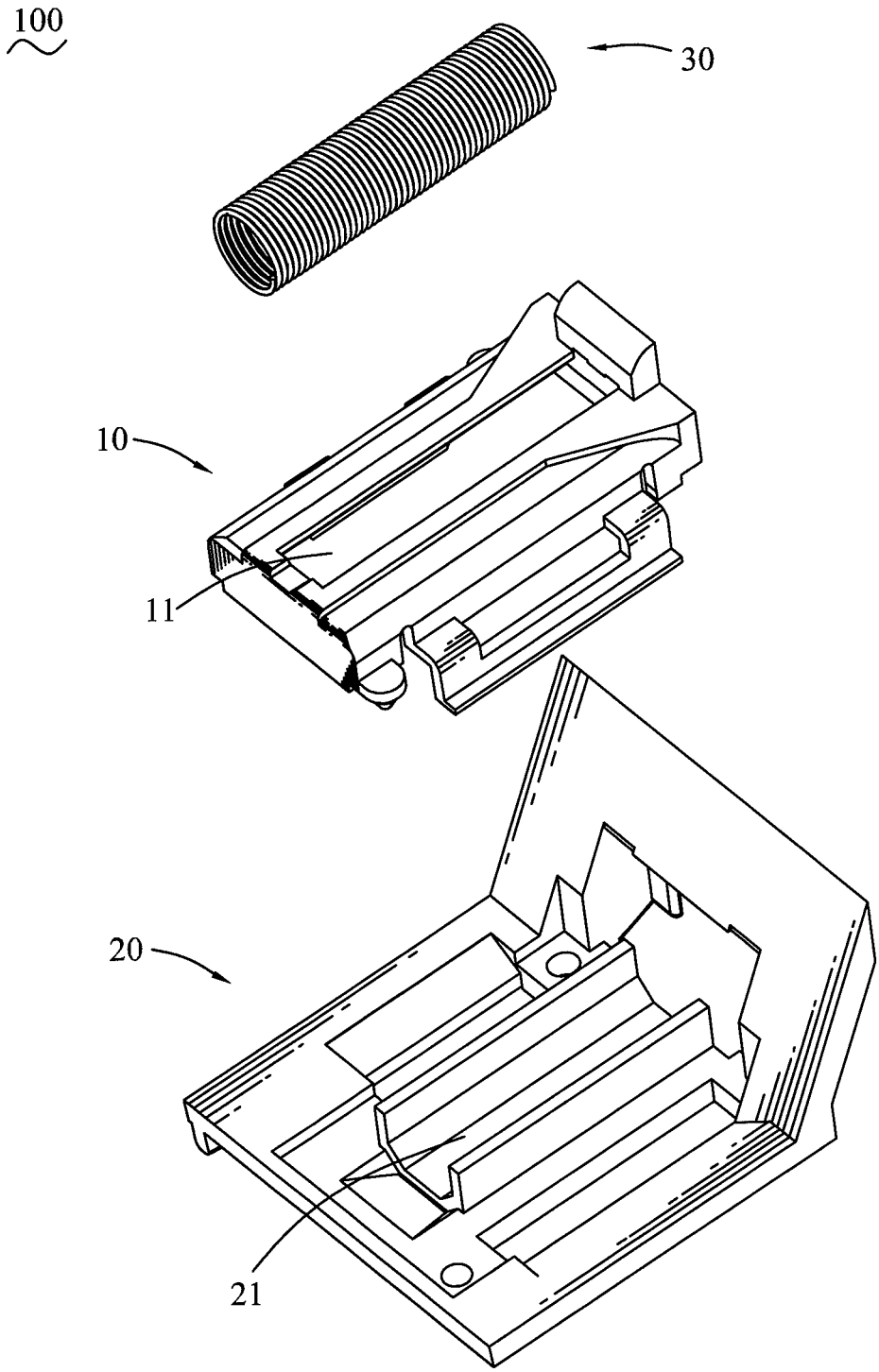
FIG. 4 is an exploded view of the sheet separation mechanism of FIG. 3.
Figure 5:
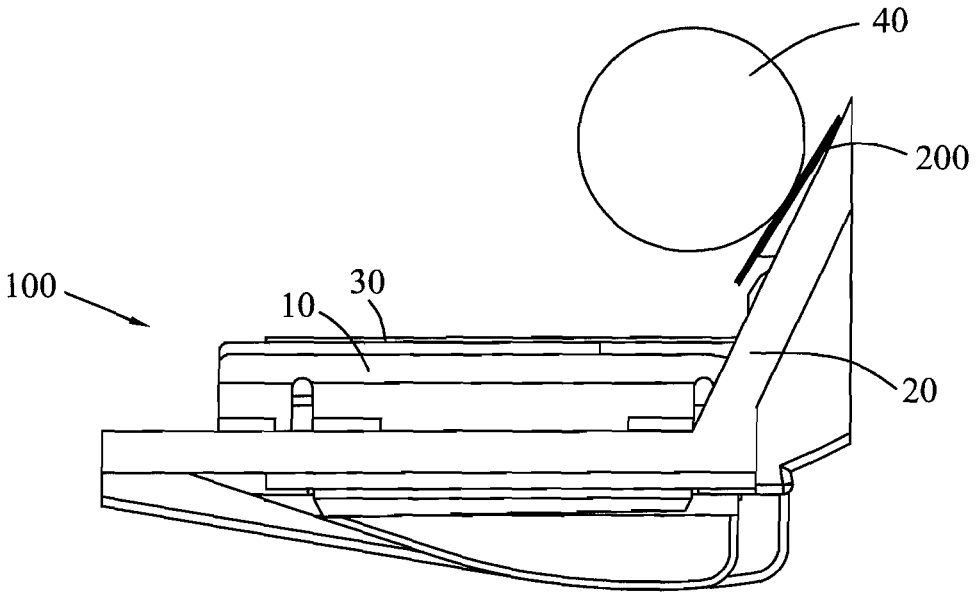
FIG. 5 is a side view of the sheet separation mechanism of FIG. 3.

Referring to FIG. 4 and FIG. 5, a middle of a top of the bearing supporter 20 is concaved downward to form a receiving groove 21 extending longitudinally. A middle of the sheet separation holder 10 is cut off to define an opening 11 extending longitudinally and vertically penetrating therethrough. The opening 11 is narrower than the receiving groove 21 in width.

Referring to FIG. 3 and FIG. 4, the sheet separation spring 30 is of a helical spring and is rolled by a spring wire. The sheet separation spring 30 shows a cylindrical shape. The sheet separation spring 30 rolled by the spring wire shows a rough outer periphery surface because of a wire diameter of the spring wire of the sheet separation spring 30 is nonuniform. The sheet separation spring 30 is disposed in the receiving groove 21 of the bearing supporter 20 with an axis thereof being parallel to a bottom wall of the receiving groove 21. The sheet separation holder 10 is mounted on the bearing supporter 20 with the receiving groove 21 corresponding to the opening 11. The sheet separation spring 30 is restricted in the receiving groove 21 of the bearing supporter 20 by the sheet separation holder 10 with a top of the outer periphery surface thereof being exposed through the opening 11 beyond a top face of the sheet separation holder 10. The sheet separation spring 30 is restricted between a front sidewall and a rear sidewall of the opening 11. The sheet separation spring 30 is capable of telescopically moving forward and rearward between the front sidewall and the rear sidewall of the opening 11.

Working process of the sheet separation mechanism 100 is described as follows.

Referring to FIG. 3, FIG. 4 and FIG. 5, papers 200 are stacked on the bearing supporter 20. Bottoms of the papers

200 abut on the top of outer periphery surface of the sheet separation spring 30. When a normal force is exerted on the papers 200, the normal force is capable of being provided by a pickup roller 40. The papers 200 are disposed between the pickup roller 40 and the bearing supporter 20. When the pickup roller 40 is rotated clockwise to ruckle the papers 200, the bottoms of the papers 200 contact the top outer periphery of the sheet separation spring 30. The sheet separation spring 30 is restricted in the receiving groove 21 of the bearing supporter 20 by the sheet separation holder 10 with the top of the outer periphery surface thereof being exposed through the opening 11 beyond the top face of the sheet separation holder 10 so as to separate the papers 200 whereby and further ensure the automatic sheet feeding device transports the papers 200 piece by piece. In addition, the sheet separation spring 30 can provide a buffer force for the papers 200 directly by virtue of its own elastic properties.

As described above, the sheet separation spring 30 is restricted in the receiving groove 21 of the bearing supporter 20 by the sheet separation holder 10 with the top of the outer periphery surface thereof being exposed through the opening 11 beyond the top face of the sheet separation holder 10 so as to separate the papers 200 whereby and further ensure the automatic sheet feeding device transports the papers 200 piece by piece. Furthermore, the sheet separation spring 30 can provide the buffer force for the papers 200 directly by virtue of its own elastic properties for effectively preventing the papers 200 from being abrased. Comparing to the conventional sheet separation mechanism which utilizes the foam 30' to provide the buffer force for the sheet separation rubber element 20' to effectively prevent the papers from being abrased, the sheet separation mechanism 100 according to the present invention uses less components and has a lower cost.

What is claimed is:

1. A sheet separation mechanism adapted for being used in an automatic sheet feeding device, comprising:

a bearing supporter for positioning papers thereon, a top of the bearing supporter defining a receiving groove;

a sheet separation spring of a helical spring showing a rough outer periphery surface, the sheet separation spring being disposed in the receiving groove of the bearing supporter with an axis thereof being parallel to a bottom wall of the receiving groove; and a sheet separation holder mounted on the bearing supporter, and defining an opening corresponding to the receiving groove, the sheet separation spring being restricted in the receiving groove of the bearing supporter by the sheet separation holder with a top of the rough outer periphery surface thereof being exposed through the opening beyond a top face of the sheet separation holder so as to separate the papers whereby and further ensure the automatic sheet feeding device transports the papers piece by piece.

2. The sheet separation mechanism as claimed in claim 1, wherein the sheet separation spring can provide a buffer force for the papers directly by virtue of its own elastic properties.

3. The sheet separation mechanism as claimed in claim 1, wherein the sheet separation spring is rolled by a spring wire and shows a cylindrical shape, the sheet separation spring shows the rough outer periphery surface because a wire diameter of the spring wire of the sheet separation spring is non-uniform.

* * * * *